US005785271A

United States Patent [19]

Leskinen et al.

[11] Patent Number: 5,785,271

[45] Date of Patent: Jul. 28, 1998

[54] METHOD AND APPARATUS FOR REGULATING WINDING OF A WEB

[75] Inventors: Arto Leskinen, Nukari; Pertti Vainio, Helsinki, both of Finland

[73] Assignee: Valmet Corporation, Helsinki, Finland

[21] Appl. No.: 871,810

[22] Filed: Jun. 9, 1997

[30] Foreign Application Priority Data

Jun. 10, 1996 [FI] Finland ..... 962396

[51] Int. Cl.[6] ..... B65H 18/26

[52] U.S. Cl. ..... 242/530.1; 242/541.5

[58] Field of Search ..... 242/541.5, 542, 242/547, 530.1

[56] References Cited

U.S. PATENT DOCUMENTS 3,648,342 3/1972 Dorfel ..... 242/541.5

3,837,593 9/1974 Dorfel ..... 252/541.5

*Primary Examiner*—John P. Darling

*Attorney, Agent, or Firm*—Steinberg & Raskin, P.C.

[57] ABSTRACT

A method of regulation in winding, wherein a number of separate rolls are formed around separate roll cores situated one after another and side by side while being supported by support members and loaded by linear loads produced by truncated rolls in a set of truncated press rolls. The distance at each particular time between at least one truncated roll in the set of truncated press rolls and a beam that loads the set of truncated press rolls is measured. Based on the measured distance, a measurement signal is passed to a regulator which provides a regulation signal to valves that control actuators of the beam so as to adjust the distance between the beam and the set of truncated press rolls to the desired value.

8 Claims, 3 Drawing Sheets

METHOD AND APPARATUS FOR REGULATING WINDING OF A WEB

FIELD OF THE INVENTION

The invention relates to a method for regulating winding of a material or fibrous web, wherein a number of separate rolls are formed around separate roll cores arranged one after another and side by side, the roll cores being supported by support members and loaded by linear loads produced by truncated rolls in a set of truncated press rolls.

BACKGROUND OF THE INVENTION

Owing to variations in the cross-direction profiles of the web to be wound, such as thickness, moisture, and roughness, the diameters of the adjacent, separate rolls do not become precisely equally large in spite of the fact that, in principle, exactly equally long component webs are wound onto these separate rolls. As such, owing to the different diameters of the rolls, the roll cores placed in their centers are displaced in relation to one another during the progress of the winding so that their centers of rotation are separated and, at the same time, minor variation also occurs in the angular speeds of the rolls. However, since the roll centers are in contact with one another during the entire winding, diverting forces arise between the winding cores and as a result, the rolls tend to "jump" which leads to vibrations, whereby the rolls that are being formed can be damaged. Owing to this detrimental vibration, in drum winding, it is usually necessary to operate the winding apparatus more slowly, and in the present, one has been content to wind the web at a lower winding speed which unfortunately reduces the capacity of the machine and is, thus, uneconomical.

In typical prior art constructions, the regulation of the position of the set of truncated press rolls takes place as follows. From the spool locks, the diameters of the rolls to be wound are measured, and the measurement signals are passed to a computer device. Based on the measurement signals, the computer device computes a guide value for the circuit of regulation of the beam that supports the truncated rolls. Further, the position of the beam is measured, and the measurement signal is passed to the regulator. The regulator passes a regulation signal to hydraulic valves, which control the hydraulic actuators of the beam.

Drawbacks of this prior art regulation system are the complicated and complex computing, the high requirement of precision, and the requirement of a larger stroke length of the cylinders in the truncated press rolls.

OBJECTS AND SUMMARY OF THE INVENTION

An object of the present invention is to provide an improvement over the prior art winding methods for regulation of the position of a set of truncated press rolls.

It is another object of the present invention to provide a new and improved method and apparatus for regulating winding of a material or fibrous web.

It is yet another object of the invention to provide a new and improved method and apparatus for regulating winding of a web in which the winding speed may be higher than in prior art winding apparatus.

In order to achieve these objects and others, in the method of regulation in accordance with the present invention, the distance at each particular time between at least one truncated roll in the set of truncated press rolls and the beam that loads the set of truncated press rolls is measured and a measurement signal generated thereby, and the measurement signal is passed to a regulator which generates a regulation signal for controlling valves that control the actuators of the beam so as to adjust the distance between the beam and the set of truncated press rolls to the desired measure.

In some embodiments of the method of regulation in accordance with the invention, the distance at each particular time between at least one truncated roll in the set of truncated press rolls and the beam is measured and the measurement signal is passed to a regulator. Further, a set value or a guide value is passed to the regulator. The regulator gives a regulation signal to the valves that control the cylinders in the beam, in which connection the cylinders adjust the distance between the beam and the truncated roll to the desired level.

Thus, in a basic embodiment of the method for regulating winding of a material web, the distance between at least one of the truncated rolls and the beam that loads the truncated press rolls is measured, and the position of the beam relative to the truncated rolls is adjusted based at least in part on the measured distance between that truncated roll and the beam. A measurement signal may be generated based on the measured distance between that truncated roll and the beam and passed to a regulator which generates a regulation signal for controlling actuators of the beam which are operable to adjust the position of the beam in order to provide a desired distance between the truncated rolls and the beam. The regulation signal is then passed to valves that control the actuators of the beam so as to adjust the distance between the beam and the truncated press rolls to the desired distance. One or more detectors may be arranged to measure the distance between the truncated roll(s) and the beam. If the truncated press rolls are mounted to a fastening bracket, the detector(s) are arranged to measure the distance between the fastening bracket and the beam.

The apparatus for winding a material web includes measurement means for measuring the distance between at least one of the truncated rolls and the beam that loads the truncated press rolls, and adjusting means for adjusting the position of the beam relative to the truncated roll(s) based at least in part on the measured distance between the truncated roll(s) and the beam. The measurement means may be structured and arranged to generate a measurement signal based on the measured distance between the truncated roll(s) and the beam, in which case, the apparatus includes actuators associated with the beam for adjusting the position of the beam, valves for controlling the operation of the actuators, and regulation means for receiving the measurement signal and generating a regulation signal for setting the valves.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
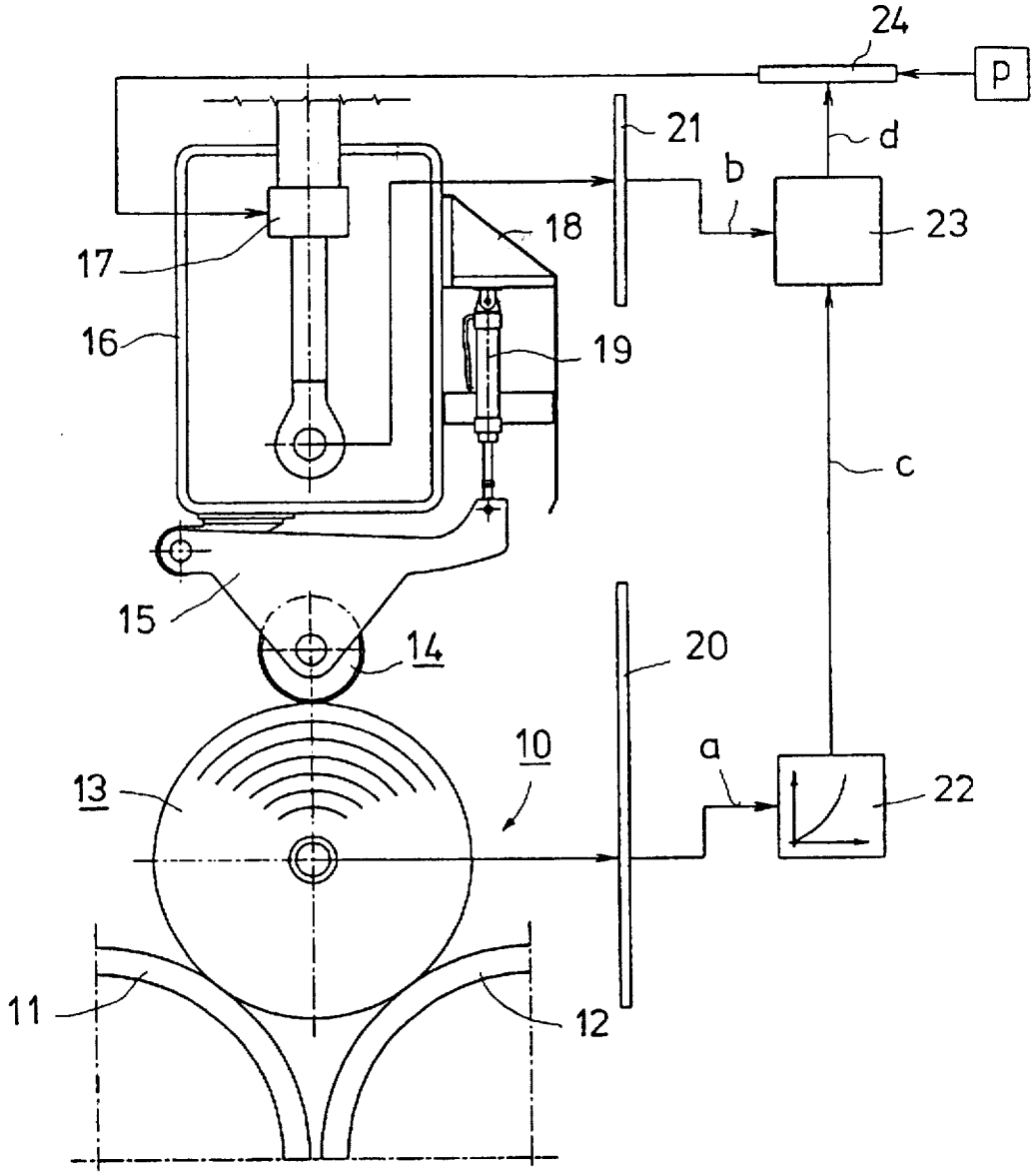
FIG. 1 PRIOR ART
FIG. 1 is a schematic side view of a prior art method of regulation.
Figure 2:
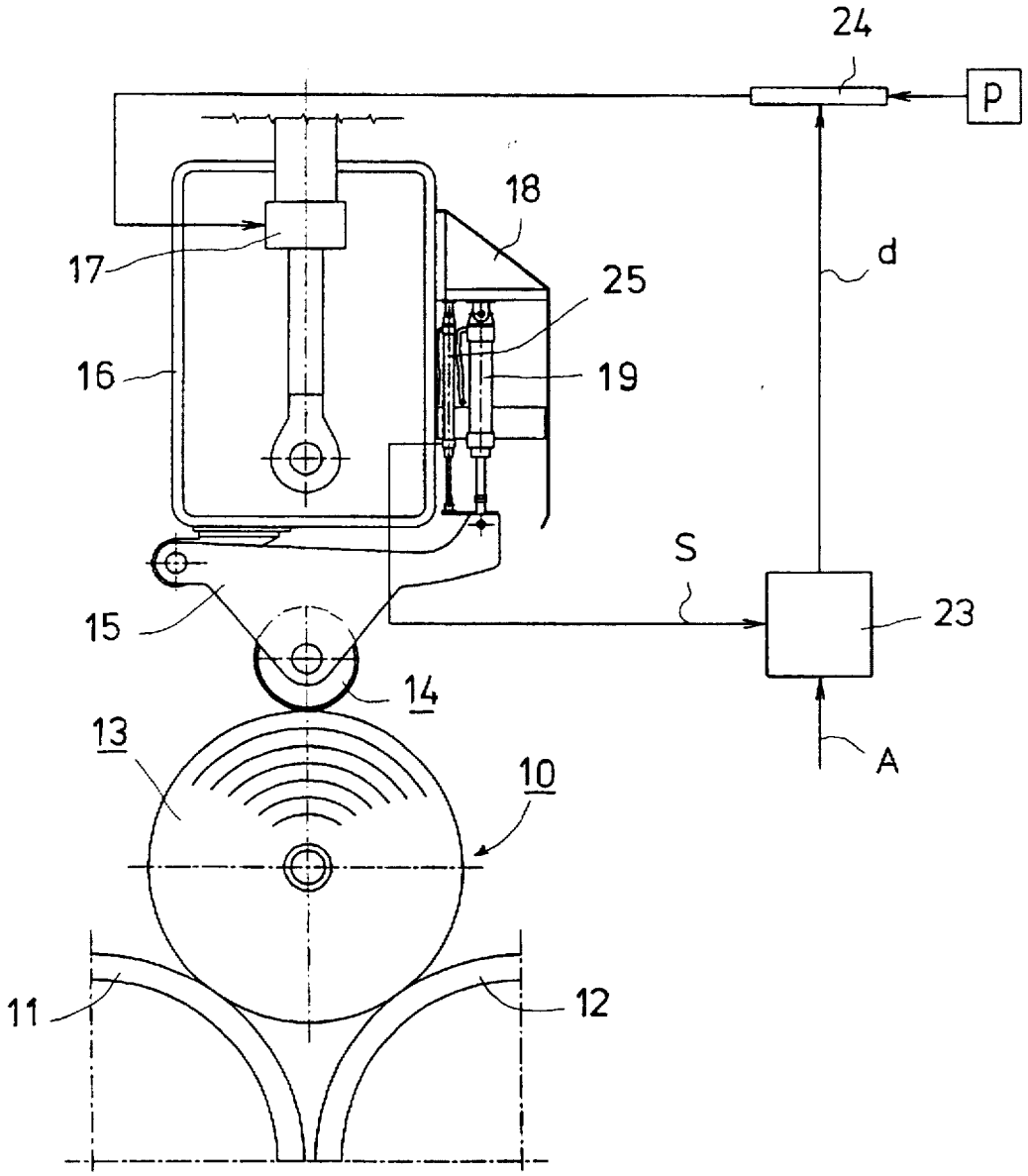
FIG. 2 is a schematic side view of a preferred embodiment of the method of regulation in accordance with the invention.
Figure 3:
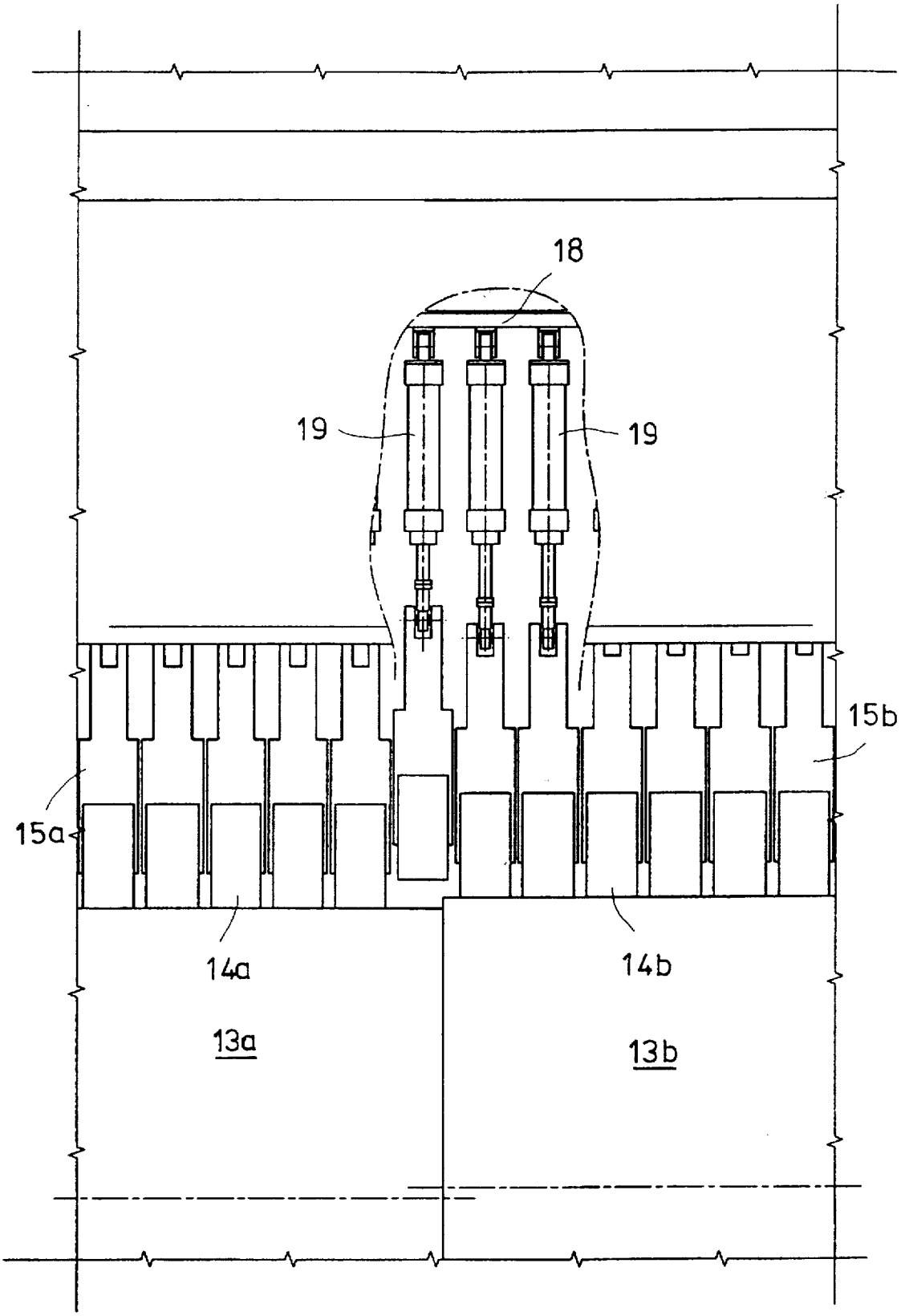
FIG. 3 shows the embodiment as shown in FIG. 2 viewed from the front.

Referring to FIGS. 1–3 wherein like reference numerals refer to the same or similar elements, the prior art method of regulation illustrated in FIG. 1 has been applied to drum winding. In FIG. 1, the drum winder is denoted generally by reference numeral 10. The drum winder 10 comprises carrier drums 11 and 12. Separate rolls 13*a*, 13*b*, etc. to be wound (not shown since they extend in a direction into the sheet of paper) are denoted generally by reference numeral 13. The set of truncated press rolls is denoted generally by reference numeral 14. Each truncated press roll in the set of truncated press rolls 14 is attached to a respective fastening bracket 15. Cylinders 19 regulate the loading of the set of truncated press rolls 14 and are attached, from one end, to the fastening brackets 15 and from the other end to a fastening bracket 18. The cylinders that displace a beam 16 that loads the set of truncated press rolls 14 are denoted by reference numeral 17.

The procedure in the regulation of the position of the press roll in the set of truncated press rolls 14 as shown in FIG. 1 is as follows. The diameters of the rolls 13 are measured from the spool lock 20, and a measurement signal a generated thereby is passed to a computer device 22. The position of the beam 16 is measured by means of a position measurement device 21, and a measurement signal b generated thereby is passed to a regulator 23. The computer device 22 computes a guide value c from the measurement signal a, which value c is passed to the regulator 23. The regulator 23 provides a regulation signal d to hydraulic valves 24 which control the cylinders 17 of the beam 16.

In the embodiment in accordance with the invention shown in FIGS. 2 and 3, the distance between at least one truncated roll 14*a*, 14*b* in the set of truncated press rolls 14 and the beam 16 is measured. A measurement signal S, representative of this measurement, is passed to the regulator 23. A set value or a guide value A is also passed to the regulator 23, e.g., which may be generated by a computer based on the measured diameter of the roll being wound against which the at least one truncated press roll is operative. Based on the measurement signal and/or the guide value, the regulator 23 generates and provides a regulation signal d to the hydraulic valves 24, which control the cylinders 17 in the beam 16. In FIG. 2, the measurement detector is denoted by reference numeral 25. In principle, only one detector 25 is needed but, as a rule, it is recommended to use two or three detectors 25. As shown in FIG. 3, there is one cylinder 19 for each truncated roll 14*a*, 14*b* in the set of truncated press rolls 14, in other words, each truncated roll 14*a*, 14*b* has a cylinder 19 of its own. The cylinders 19 are attached from one end to the fastening brackets 15*a*, 15*b* and from the other end to the fastening bracket 18.

Although it is ideal to measure the distance between at least one truncated roll 14*a*, 14*b* in the set of truncated press rolls 14 and the beam 16 at each particular time, i.e., continually, this distance can be measured periodically if so desired. Measurement for one truncated roll usually suffices since all of the truncated rolls in each set of truncated rolls operative against the same roll being wound have the same position (as shown in FIG. 3).

The examples provided above are not meant to be exclusive. Many other variations of the present invention would be obvious to those skilled in the art, and are contemplated to be within the scope of the appended claims.

We claim:

1. In a method for regulating winding of a material web in which a plurality of separate rolls are formed around separate roll cores arranged one after another and side by side, each roll being supported by support members and loaded by linear loads produced by truncated rolls in a set of truncated press rolls, a beam being provided to load the truncated press rolls, the position of the beam relative to the rolls being adjustable, the method comprising the steps of.

measuring a distance between at least one of the truncated rolls and the beam, generating a measurement signal based on the measured distance between said at least one truncated roll and the beam, passing the measurement signal to a regulator, generating a regulation signal in the regulator for controlling actuators of the beam which are operable to adjust the position of the beam in order to provide a desired distance between the truncated rolls and the beam, and passing the regulation signal to valves that control the actuators of the beam so as to adjust the distance between the truncated rolls and the beam to the desired distance.

2. The method of claim 1, further comprising the step of:

arranging at least one detector to measure the distance between said at least one truncated roll and the beam.

3. The method of claim 2, further comprising the steps of:

mounting the truncated press rolls to a fastening bracket, and arranging said at least one detector to measure the distance between said fastening bracket and the beam.

4. The method of claim 1, wherein the distance between said at least one truncated roll and the beam is continually measured during winding of the web.

5. In an apparatus for winding a material web in which a plurality of separate rolls are formed around separate roll cores arranged one after another and side by side, each roll being supported by support members and loaded by linear loads produced by truncated rolls in a set of truncated press rolls, a beam being provided to load the truncated press rolls, the position of the beam relative to the rolls being adjustable, the improvement comprising measurement means for measuring the distance between at least one of the truncated rolls and the beam, said measurement means being structured and arranged to generate a measurement signal based on the measured distance between said at least one truncated roll and the beam, actuators associated with the beam for adjusting the position of the beam, valves for controlling the operation of said actuators, and regulation means for receiving the measurement signal and generating a regulation signal for setting said valves.

6. The apparatus claim 5, wherein said measurement means comprise at least one detector arranged between said at least one truncated roll and the beam.

7. The apparatus of claim 6 further comprising a fastening bracket, the truncated press rolls being mounted to said fastening bracket, said at least one detector being arranged to measure the distance between said fastening bracket and the beam.

8. The apparatus of claim 5, wherein said measurement means are structured and arranged to continually measure the distance between said at least one truncated roll and the beam during winding of the web.

* * * * *